US011980263B2

(12) United States Patent
Fraser

(10) Patent No.: US 11,980,263 B2
(45) Date of Patent: May 14, 2024

(54) PORTABLE SHELTER

(71) Applicant: Mark Andrew Fraser, Hamilton (AU)

(72) Inventor: Mark Andrew Fraser, Hamilton (AU)

( * ) Notice: Subject to any disclaimer, the term of this patent is extended or adjusted under 35 U.S.C. 154(b) by 0 days.

(21) Appl. No.: 17/424,286

(22) PCT Filed: Jan. 22, 2020

(86) PCT No.: PCT/AU2020/050033

§ 371 (c)(1),
(2) Date: Jul. 20, 2021

(87) PCT Pub. No.: WO2020/150773

PCT Pub. Date: Jul. 30, 2020

(65) Prior Publication Data

US 2022/0087376 A1 Mar. 24, 2022

(30) Foreign Application Priority Data

Jan. 22, 2019 (AU) ..... 2019900194
Mar. 8, 2019 (AU) ..... 2019100254
Jan. 4, 2021 (AU) ..... 2021900005

(51) Int. Cl.
*A45B 19/10* (2006.01)
*A45B 23/00* (2006.01)
*A45B 19/00* (2006.01)

(52) U.S. Cl.
CPC ..... *A45B 19/10* (2013.01); *A45B 23/00* (2013.01); *A45B 2019/008* (2013.01); *A45B 2023/0006* (2013.01); *A45B 2023/0012* (2013.01)

(58) Field of Classification Search
CPC .... A45B 19/10; A45B 23/00; A45B 2019/008
See application file for complete search history.

(56) References Cited

U.S. PATENT DOCUMENTS 1,800,119 A 5/1928 Tuthill
1,908,453 A 5/1933 Schmidt
(Continued)

FOREIGN PATENT DOCUMENTS

GB 2162060 A * 1/1986 ..... A45B 23/00
TW M252301 U 3/1993
(Continued)

OTHER PUBLICATIONS

Extended European Search Report dated Aug. 26, 2022 in connection with related European Patent Appl. No. 20744993.5.
(Continued)

*Primary Examiner* — Noah Chandler Hawk
(74) *Attorney, Agent, or Firm* — Brooks Kushman P.C.

(57) ABSTRACT

The present invention relates to a portable shelter assembly. The assembly includes a support; and an expandable shelter for being supported by the support and expanding to shelter at least one person. The shelter includes ribs extending from the support. Each rib includes one or more proximal elements pivotally mounted to the support. Each rib further includes a distal element extending from the proximal elements and configured to move outwardly to expand the shelter when the proximal elements pivot in a first direction. Advantageously, the distal elements may be simply pulled down one at a time to lift the connected proximal elements and extend the ribs, which is advantageous in windy conditions, or pulled down together to lift the proximal elements and extend the ribs.

19 Claims, 8 Drawing Sheets

(56) References Cited

U.S. PATENT DOCUMENTS

| | | | | |
|---|---|---|---|---|
| 1,964,292 | A | 6/1934 | Livingston | |
| 2,059,463 | A * | 11/1936 | Kemp | E04H 15/28 135/98 |
| 2,492,457 | A | 12/1949 | Benton | |
| 3,902,514 | A * | 9/1975 | Weber | A45B 19/10 135/25.33 |
| 8,991,412 | B2 | 3/2015 | Holland et al. | |
| 9,629,426 | B1 * | 4/2017 | Dai | A45B 19/10 |
| D884,815 | S * | 5/2020 | Hu | D21/837 |
| 2004/0182429 | A1 | 9/2004 | Chen | |
| 2012/0006370 | A1 * | 1/2012 | Liljekvist | A45B 19/06 135/31 |
| 2017/0152673 | A1 * | 6/2017 | Fraser | E04H 15/28 |

FOREIGN PATENT DOCUMENTS

| | | | |
|---|---|---|---|
| WO | WO2008/114305 | A2 | 9/2008 |
| WO | WO2018/107238 | A1 | 6/2018 |

OTHER PUBLICATIONS

PCT International Search Report dated Mar. 25, 2020 in connection with PCT/AU2020/050033 filed Jan. 22, 2020.
Australian Examination Report dated Sep. 16, 2019 in connection with Australian Patent Appl. No. 2019100254 filed Mar. 8, 2019.

* cited by examiner

PORTABLE SHELTER

TECHNICAL FIELD

The present invention relates to a portable shelter. The present invention has particular, although not exclusive application to beach shelters, umbrellas and other like outdoor shelters.

BACKGROUND

The reference to any prior art in this specification is not, and should not be taken as an acknowledgement or any form of suggestion that the prior art forms part of the common general knowledge.

Skin cancer and other skin damage from the sun is increasing at alarming rate. In order to order to minimize skin damage, beach goers can bring beach umbrellas to the beach. The umbrellas may be jammed into the sand and expanded to provide shelter to a beach goer.

However, in practice, beach umbrellas are prone to blow away in the wind. Accordingly, the canopy of a beach umbrella is often rested on the sand to stabilize the umbrella. Resting the umbrella in this manner undesirably results in the beach goer needing to crouch awkwardly beneath the umbrella and generally provides only partial sun protection as part of the beach goer is exposed.

Other types of shelter are also known. A semi-enclosed expandable shelter has flexible ribs that extend to ground level to tension the shelter. These shelters undesirably lack air flow and adequate height to provide suitable ventilation and cooling for their occupants and can be difficult to foldaway.

Large "scissor" action shelter have extendable legs requiring two or more people to erect. These shelters are difficult to easily transport to and from the beach.

A known shelter is reliant upon the wind to be kept open to provide adequate room for it's occupants. Often, there is not enough wind to keep these shelters open enough with the outcome that beach goers do not stay long, do not enjoy their time at the beach or simply do not use any shelter thereby increasing their susceptibility to skin cancers.

There are 2 main types of existing umbrellas: namely large golf type umbrellas that fold in length to more than 1 m or compact "handbag" umbrellas that use a tri-folding mechanism to fold small enough to fit inside a handbag or satchel for convenience. Both types fold in manner which exposes the outer top "wet" surface of the canopy when closed. Compact handbag umbrellas require a complex opening and closing process comprising many parts which must be small in order to achieve their compact fold. This undesirably results in many weak umbrellas that have a short lifespan and end up as waste.

The preferred embodiment provides an improved shelter for beach goers and umbrellas for protection from rain and sun.

SUMMARY OF THE INVENTION

According to one aspect of the present invention, there is provided a portable shelter assembly including:

a support; and an expandable shelter for being supported by the support and expanding to shelter at least one person, the shelter including ribs extending from the support, each rib including:

one or more proximal elements pivotally mounted to the support, and a distal element extending from the proximal elements and configured to move outwardly to expand the shelter when the proximal elements pivot in a first direction.

Advantageously, the distal elements may be simply pulled down one at a time to lift the connected proximal elements and extend the ribs, which is advantageous in windy conditions, or pulled down together to lift the proximal elements and extend the ribs.

The distal and proximal elements may fold together when collapsing the shelter (e.g. umbrella) so that outer surfaces of an expanded canopy supported by the ribs fold together. Advantageously, moisture from rain may be contained within the collapsed shelter, and the outer surface of the collapsed shelter (being the inner surface of the expanded canopy) is dry.

The (three) rib elements required to open the shelters arm may be substantially parallel and/or stacked when the shelter is collapsed to advantageously form an extremely compact shelter for storage whilst forming an expansive shelter when expanded. When stacked, the distal element may be located between the proximal elements.

The distal element may be further configured to move inwardly to collapse the shelter when the proximal elements pivot in a second direction opposite the first direction. The first direction may be an upward direction. Ends of the proximal elements may come together proximal the distal element during expansion of the shelter to form a secure triangular structure.

The distal element may be pivotally mounted to at least one of the proximal elements, and may pivot in an opposite direction to the proximal elements.

At least one of the proximal elements may include retainer for retaining the distal element. At least one of the proximal elements may include a guide permitting sliding of the distal element there-through. The distal element may include an impediment for impeding free sliding through the guide. The impediment may include a rounded formation. The expandable shelter may include a canopy which impedes further rotation of the proximal elements.

At least one of the proximal elements may be pivotally connected to the distal element at a connection point on the distal element that is located at a distance from a proximal end of the distal element. The distal element may include an impediment at the connection point to prevent pivoting of the distal element relative to the proximal elements beyond a predetermined angle.

The shelter may include stretchers for expanding the ribs from the support. The shelter may include a runner for running along the support to actuate the stretchers. The shelter may include a lock for locking the runner in place when the shelter is expanded. In both versions where the main arm and secondary support arm connect to the centre support these are fixed hinged locations unlike umbrellas with a sliding mechanism used to open and close them where only the top main arm is fixed in it's location and the lower support arm is connected to a moving slider.

The shelter may include a biasing means (e.g. spring) for biasing the runner to open and expand the shelter. The shelter may include a push button to release the runner to slide along the support under influence of the biasing means.

The proximal elements may include two or three elements. The elements may include an upper element, a lower element and an outer upper element that rotates to open or close about the upper and lower element. Each element may include a rod.

The shelter assembly may further include one or more anchors for anchoring the shelter, and including receptacles for receiving material.

The receptacles may include sheet material. The anchors may include respective strips extending from a periphery of the shelter. The strips may include sheet material. The strips may include corner strips. One or more of the strips may include respective interior pockets.

The support may include a spike for spiking into the ground (e.g. sand or grass). The support may include a pole for releasably fastening to the spike which may also act as a hammer to hammer the said spike(s) into sand or grass.

The shelter may be expanded in two steps, namely: a first step for opening the shelter and a second step for tightening the shelter. The canopy may include a sheet of material. The shelter may include ribs supporting the canopy. In one embodiment the ribs are axially expandable to tighten the canopy. Each rib may include a lock for locking the rib in an expanded configuration. In another embodiment, the ribs are pivotally expandable to extend and possibly tighten the canopy. Each rib may include a restraint for restraining pivoting. The canopy may be tensioned by the ribs pushing against it. The shelter may include stretchers for expanding the ribs from the support. The shelter may include a runner for running along the support to actuate the stretchers. The shelter may include a lock for locking the runner in place when the shelter is expanded.

The shelter assembly may be collapsed to be stowed in a carry-bag. The shelter may be square or circular. The assembled shelter may be of sufficient height to accommodate a standing person or held in the hand in the same way an umbrella is held. The ribs or support may include lightweight, resilient tubes (e.g. aluminium or fibre reinforced material).

According to another aspect of the present invention, there is provided a rib for an expandable shelter with a support, the rib including: one or more proximal elements pivotally mounted to the support; and a distal element extending from the proximal elements and configured to move outwardly to expand the shelter when the proximal elements pivot.

According to another aspect of the present invention, there is provided a method for assembling a portable shelter assembly, the method including:

- erecting a support;
- supporting an expandable shelter with the support, the shelter including ribs extending from the support, each rib including:
  - one or more proximal elements pivotally mounted to the support, and
  - a distal element extending from the proximal elements and configured to move outwardly to expand the shelter when the proximal elements pivot in a first direction; and
- expanding the shelter to shelter at least one person.

According to another aspect of the present invention, there is provided a method for opening and closing the shelter, the method including:

- moving a slider up the central support which lifts the lower proximal element and in so doing lifts the upper proximal element and rotates the distal element to open the shelter. To close the slider may be moved downwards rotating the distal element about the ends of the proximal elements to close it and lower the proximal elements.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
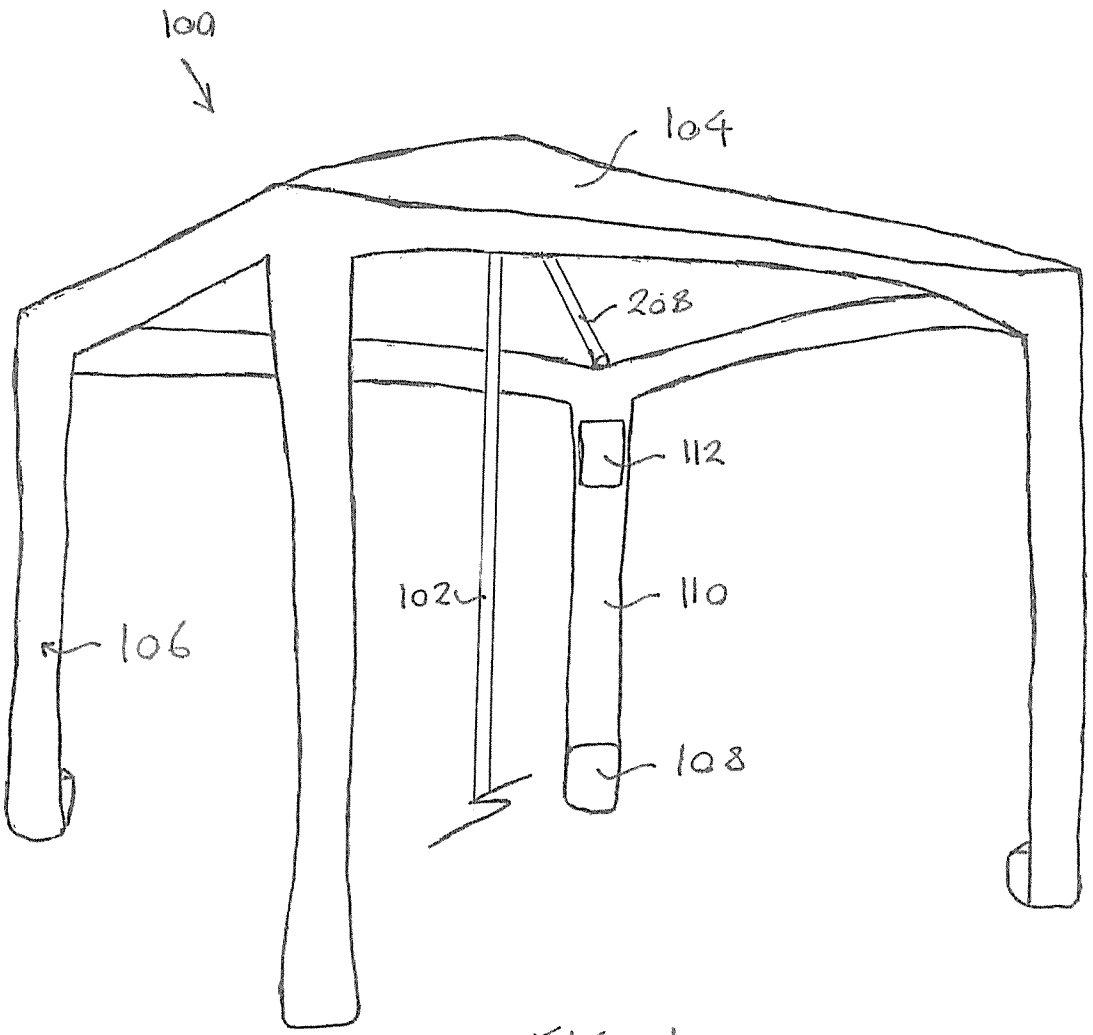
FIG. 1 is a lower perspective view of an assembled portable beach shelter assembly.

According to an embodiment of the present invention, there is provided a portable beach shelter assembly 100 as shown in FIG. 1. The shelter assembly 100 includes a vertical and central support 102. An expandable shelter 104 is supported by the support 102 and expands to shelter a person from the sun. Four corner anchors 106 are provided for anchoring the shelter 104 to the ground. Advantageously, shelter assembly 100 is wind resistant whereby the anchors anchor the shelter 104 to impede the assembly 100 from being blown away. The assembly 100 is erected by a single person and provides excellent ventilation.

The anchors 106 include base pocket receptacles 108 for receiving sand, water bottles, rocks or other like anchoring materials. The receptacles 108 are formed from stitched sheet or other material. The anchors 106 also include respective corner strips 110 extending from a corner periphery of the shelter 104 to the ground. One or more of the strips 110 may include interior storage pockets 112.

Figure 2:
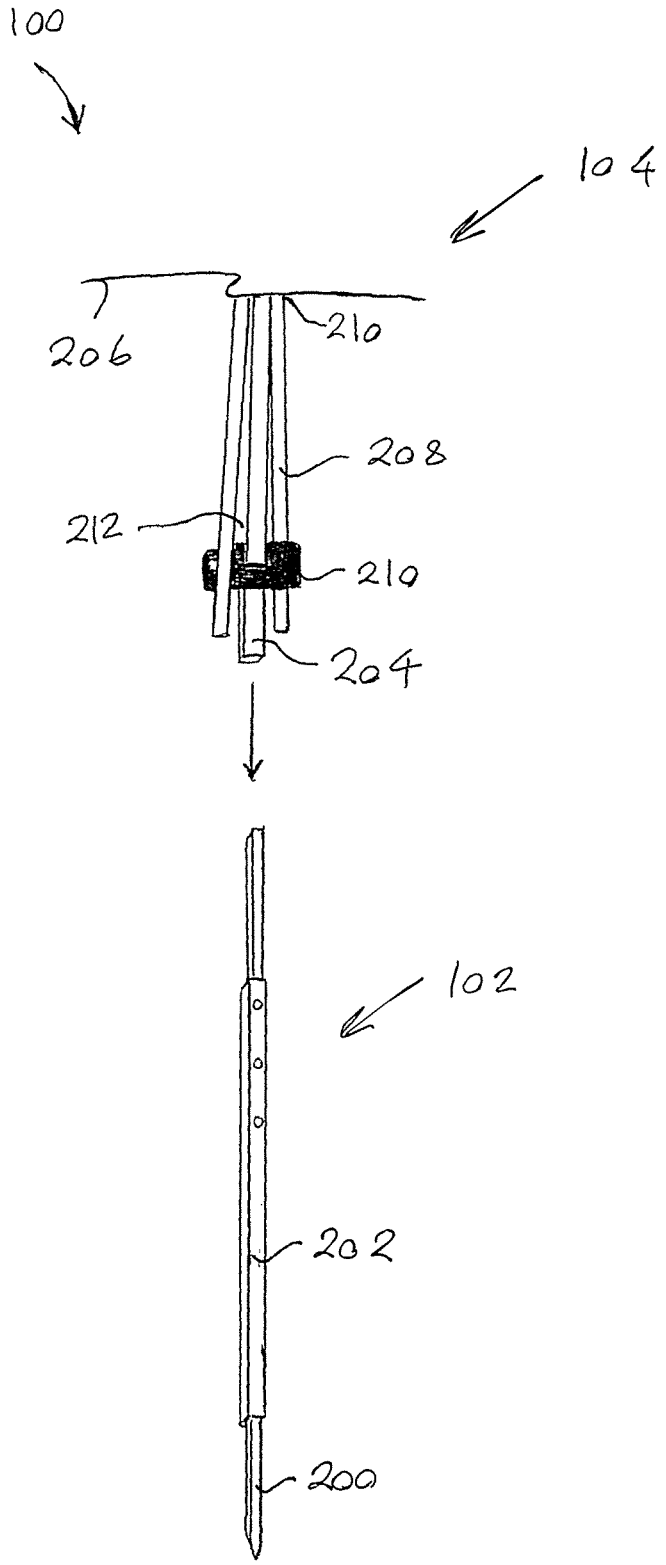
FIG. 2 is an exploded side view of the unassembled portable beach shelter assembly of FIG. 1.

Turning to FIG. 2, the support 102 includes a spike 200 for spiking into the sand (e.g. ground). The support 102 also includes a tubular hammer pole 202 for releasably receiving the spike 200. In turn, the pole 202 couples to a tubular vertical pole 204 of the shelter 104.

The expandable shelter 104 includes attached canopy 206 formed from a sheet of material. The shelter 104 includes four ribs 208 supporting the canopy 206 and pivotally anchored at a crown 209. The shelter 104 also includes stretchers 212 for expanding the ribs 208 from the support 102. A runner 210 is provided for running along the support 102 to actuate the stretchers 212. The shelter 104 may include a lock for locking the runner 210 in place when the shelter 104 is expanded.

The shelter assembly 100 can be collapsed to be conveniently stowed in a carry-bag carried by one person. The shelter 100 is generally square (FIG. 1) and expanded to be at least 1.8 metres long×1.8 metres wide, or other larger or smaller dimension as required. The assembled shelter 100 may be of sufficient height to accommodate a standing person. The ribs 208 and support 102 include lightweight, resilient tubes (e.g. aluminium) to facilitate easy handling by the single user that can conveniently erect and collapse the assembly 100.

Figure 3:
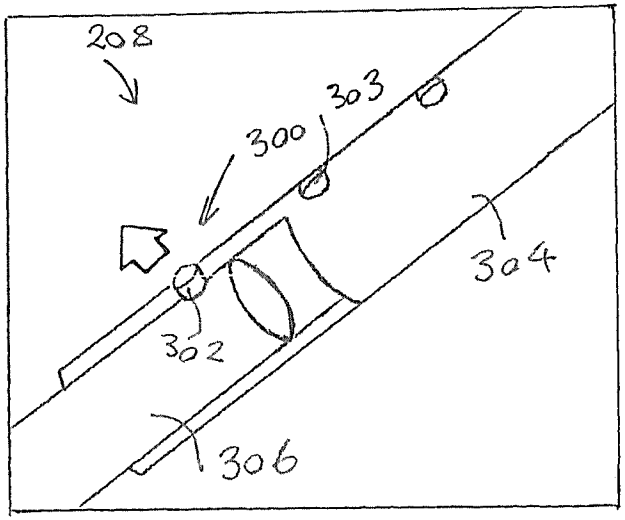
FIG. 3 is a close-up perspective view of a rib of the beach shelter assembly of FIG. 1.

The shelter 104 is initially expanded using the runner 210, and then further expanded to tighten the canopy 206 using the ribs 208. FIG. 3 shows a telescopic rib 208 which can be axially expanded to tighten the canopy 208. Each rib 208 includes a lock 300 or a ratchet type lock for locking the rib 208 in an expanded configuration. The lock 300 includes a spring-biased pushbutton 302 that protrudes through adjustment holes 303 in both sliding stems 304, 306 to lock the stems 304, 306 together.

Figure 4:
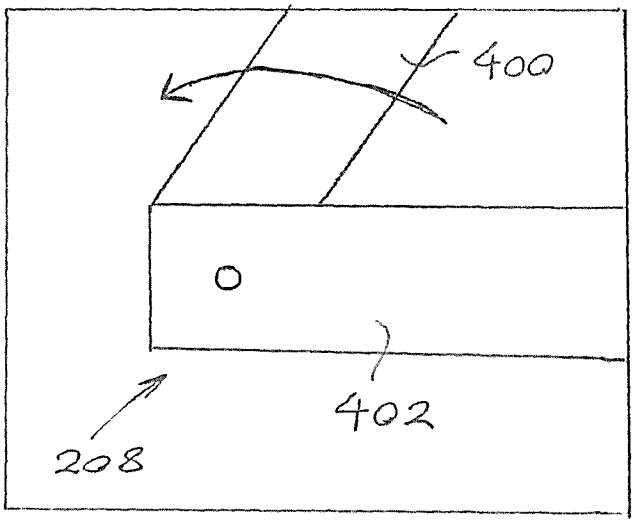
FIG. 4 is a close-up perspective view of an alternative rib of the beach shelter assembly of FIG. 1.

Alternatively, as shown in FIG. 4, the ribs 208 can be pivotally expandable to tighten the canopy 206. In this manner a top stem 400 of the rib 208 pivots downwardly to align with the level stem 402 during tightening of the canopy 206. Each rib 208 may include a mechanical restraint for restraining pivoting downwardly beyond 180° so that the erected rib 208 is substantially straight.

A method for assembling the portable shelter assembly 100 is now briefly described.

Initially, a storage bag axially slips of off the compacted shelter assembly 100.

Next, the method involves erecting the support 102. The spike 200 slides into the pole 202. The spike 200 is then hammered into the sand by forcing the pole 202 up and down.

Next, the expandable shelter 104 is supported by the support 102. The vertical pole 204 of the shelter 104 slides onto the lower pole 202.

Next, the anchor receptacles 108 are filled with sand to anchor the shelter 104.

Next, the shelter 104 is expanded in two easy steps to shelter up to two people comfortably, namely: a first step for opening the shelter 104 and a second step for tightening the shelter 104. Firstly, the runner 210 is run up the vertical pole 204 to expand the ribs 208 supporting the canopy 206. Secondly, the ribs 208 are expanded to tighten the canopy 206. Both the runner 210 and the ribs 208 may be locked in place.

Once the day is done, the portable assembly 100 may be conveniently unassembled and returned to its storage bag.

FIG. 5*a*-5*e* show an alternative rib 500, used in place of rib 208, for the expanding portable shelter 104 of FIG. 1 in accordance with an embodiment of the present invention. Like reference numerals refer to like features previously described.

The support 100 includes a pair of fixed mounts 502*a*, 502*b* which are separated along the support 100. Each rib 208 includes a pair of proximal elements 504*a*, 504*b* pivotally mounted to respective fixed mounts 502*a*, 502*b* of the support 100. The ribs 208 can be extended independently, one at a time Referring to the sequence shown in FIGS. 5*a*-5*e*, a distal element 506 extends from the collective proximal elements 504 and is configured to move outwardly to expand the shelter 104 when the proximal elements 504 pivot in a clockwise (or upward) direction. The shelter canopy 206 impedes further rotation of the proximal elements 504 beyond the fully expanded configuration of FIG. 5*e*.

Advantageously, the distal element 506 can be simply pulled anticlockwise (or downward), at its free end, to lift the proximal elements 504 and extend the rib 208. Ends of the proximal elements 504*a*, 504*b* come together proximal the distal element 506 during expansion of the shelter 104 to form a secure triangular structure.

Conversely, by pushing the distal element 506 of the expanded shelter 104 shown in FIG. 5*e* upward (or clockwise) at its free end, the distal element 506 can be further configured to move inwardly to collapse the shelter 104 when the proximal elements pivot 504 in an anticlockwise (or downward) direction (FIGS. 5*e*-5*a*).

The distal element 506 is pivotally mounted to the lower proximal element 504*b*, and pivots in an opposite direction to the proximal elements 504. The upper proximal element 504*a* includes a loop retainer for retaining the distal element 506. In this manner, the upper proximal element 504*a* includes a guide slot permitting sliding of the distal element 506 there-through. The distal element 506 also includes an impediment 508, including a rounded underside formation, for impeding free sliding through the guide and to provide some end-point resistance when collapsing and expanding the shelter 104.

Figure 6:
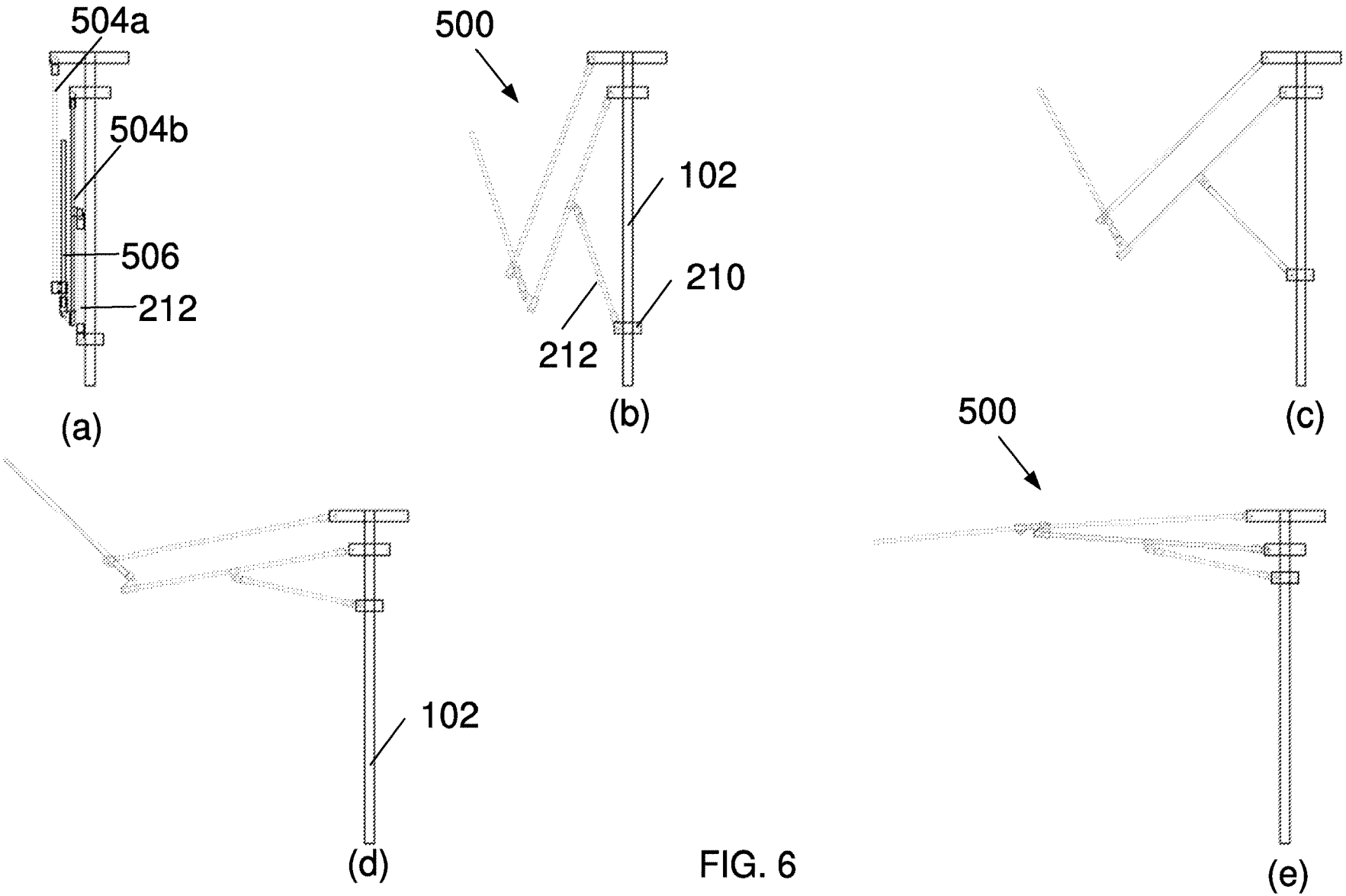
FIG. 6*a*-6*e* show sequential side views of a rib of the expanding the portable shelter of FIG. 1 in accordance with yet another embodiment of the present invention.

Turning to FIG. 6, the shelter 104 can include four stretchers 212, pivoting at either end, for expanding the four ribs 500 from the support 102. As before, the shelter 104 further includes a runner 210 for running along the support 102 to actuate the stretchers 212 together simultaneously, and a lock for locking the runner 210 in place when the shelter 104 is expanded.

The shelter 104 further includes a biasing means (e.g. spring) for biasing the runner 210 to expand the shelter 104. The shelter 104 also includes a push button to release the runner 210 to slide along the support 102 under influence of the biasing means.

Each element 504, 506 includes an elongate rod. As can best be seen in FIG. 6*a*, the elements 504, 506 and stretcher 212 fold together when collapsing the shelter 104 so that outer surfaces of the expanded canopy 206 supported by the ribs 500 fold together. Advantageously, moisture from rain can be contained within the collapsed shelter 104, and the outer of the collapsed shelter 104 (being the inner surface of the expanded canopy 206) is dry.

The elements 504, 506 and stretcher 212 are substantially parallel and stacked when the shelter is collapsed to advantageously form an extremely compact shelter 104 for storage whilst forming an expansive shelter 104 when expanded. When stacked, the distal element 506 is located between the proximal elements 504*a*, 504*b*.

Figure 5:
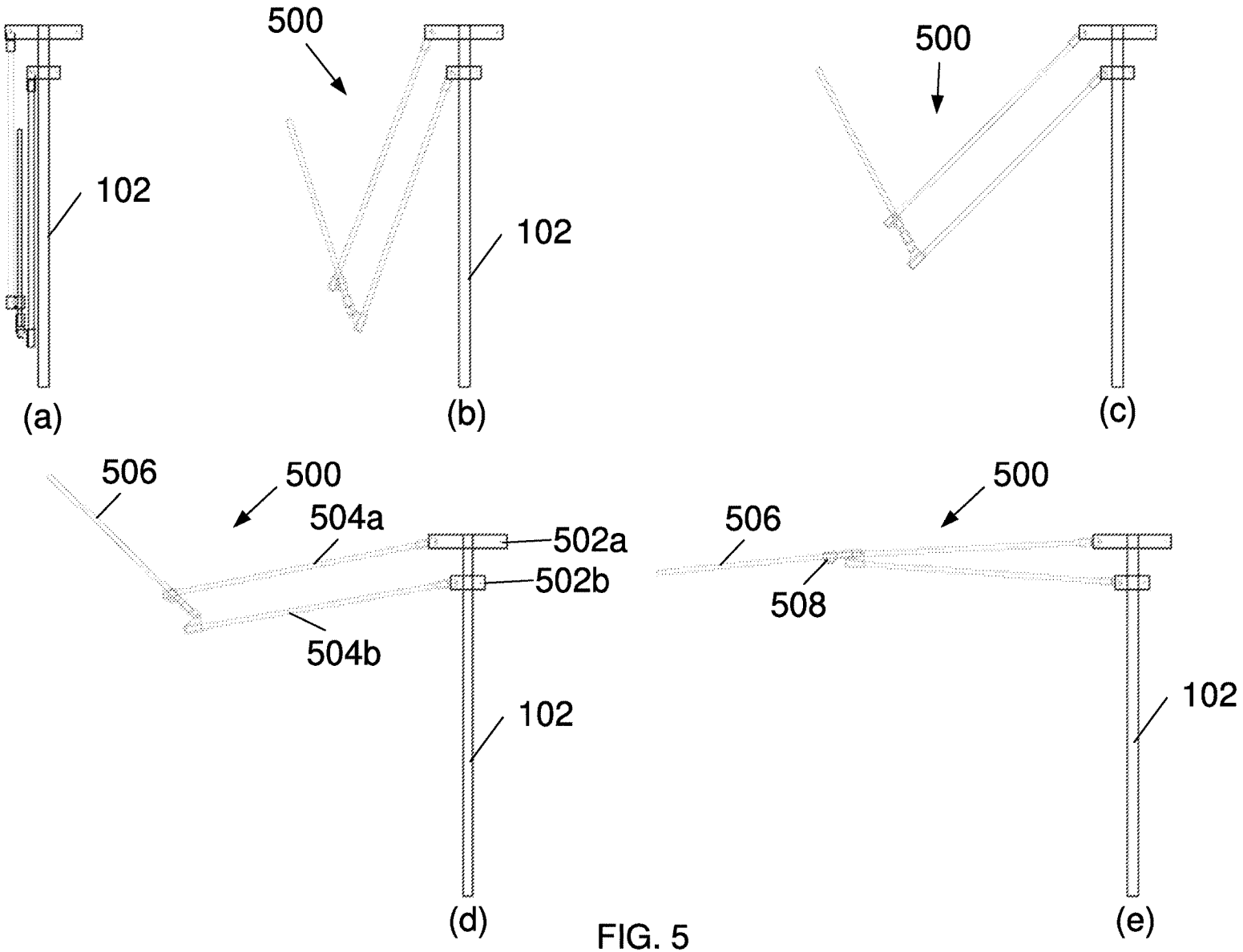
FIG. 5*a*-5*e* show sequential side views of a rib of the expanding the portable shelter of FIG. 1 in accordance with an embodiment of the present invention.

In a further alternative embodiments shown in FIGS. 7 to 9, the shelter has substantially similar ribs to the one shown in FIG. 5 but differences therebetween are noted below.

The support of the shelter of these alternative embodiments also includes a pair of fixed mounts 502*a*, 502*b*, a first mount 502*b* and a second mount 502*b*, which are separated along the support 102, with the first mount being located above the second mount (similar to the arrangement of mounts 502*a* and 502*b*). Each rib of the shelter includes a first proximal element 504*a* pivotally mounted to first mount 502*a* and a second proximal element 504*b* pivotally mounted to second mount 502*b*.

Figure 7:
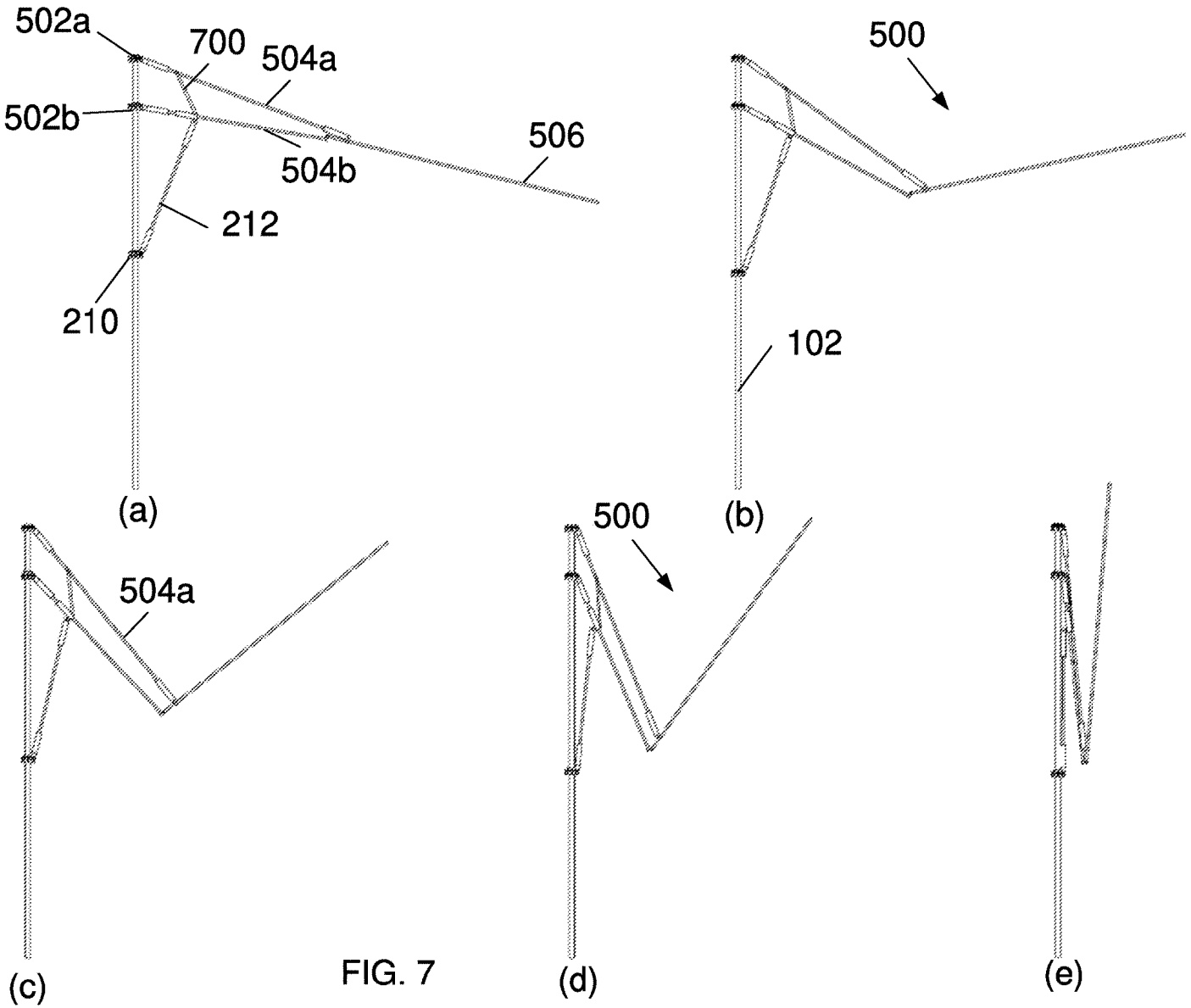
FIG. 7*a*-7*e* show sequential side views of a rib of the collapsing portable shelter of FIG. 1 in accordance with an embodiment of the present invention.

As shown in FIG. 7, a distal element 506 is pivotally mounted to the second proximal element 504*b*, with a proximal end of the distal element 506 being connected to an end of the second proximal element 504*b*, and pivots in an opposite direction to the first and second proximal elements 504*a*, 504*b*. The distal element 506 is also pivotally connected to an end of the first proximal element 504*a* (opposite to the end connected to the first mount) at a connection point that is located on the distal element 506 and at a distance from the proximal end of the distal element 506. In this manner, the distal element 506 is able to pivot relative to the first proximal element 504*a* and the second proximal element 504*b*. The distal element 506 also includes an impediment, at the connection point for preventing pivoting of the distal element (relative to the first proximal element) beyond a predetermined angle, thereby providing some end-point resistance when collapsing and expanding the shelter.

Further, another stretcher 700 is located between the first and second proximal elements 504*a*, 504*b*, above the stretcher 212. The other stretcher 700 can pivot at either end.

Figure 8:
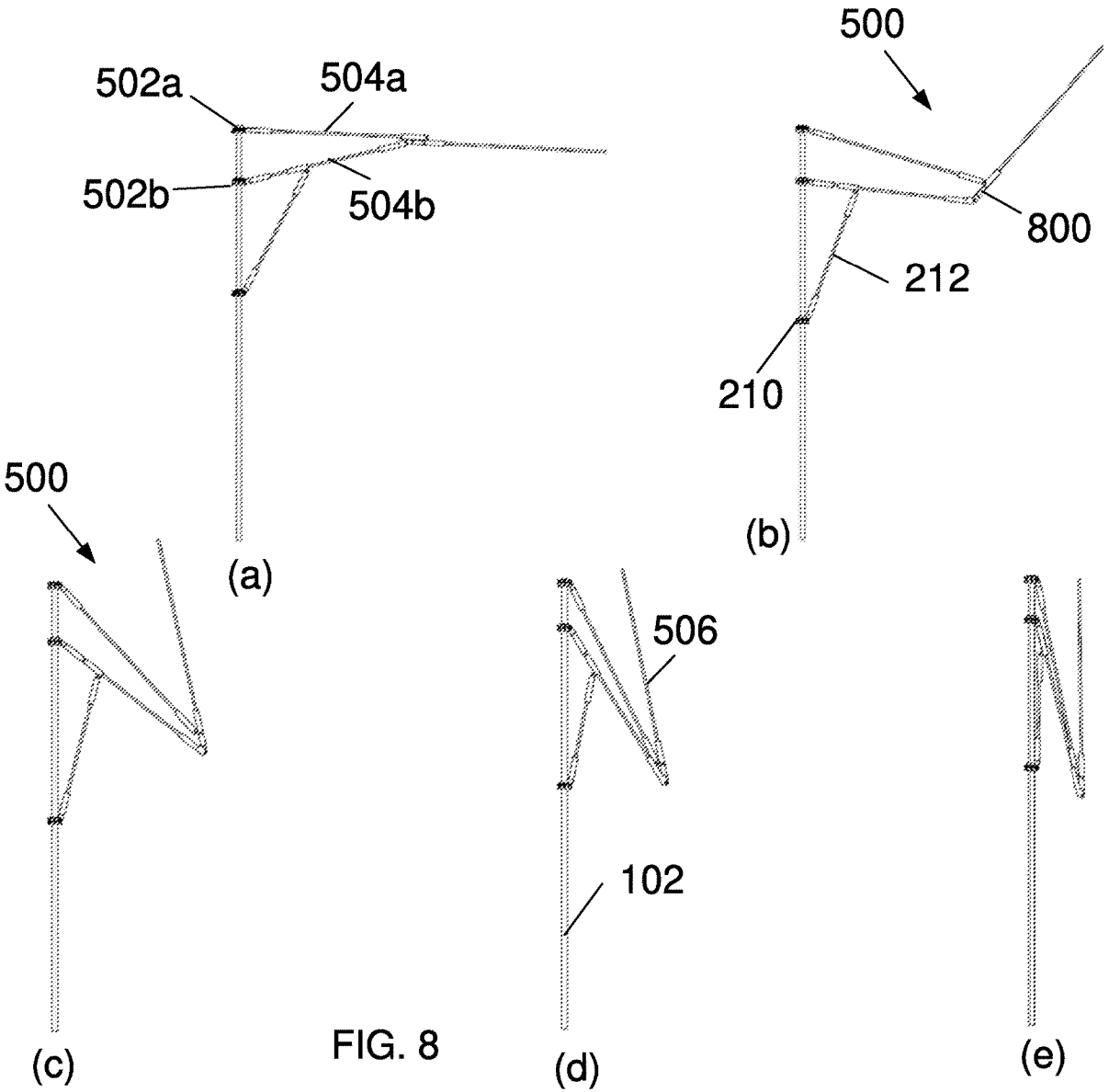
FIG. 8*a*-8*e* show sequential side views of a rib of the collapsing portable shelter of FIG. 1 in accordance with an embodiment of the present invention.

FIG. 8 includes a spacer 800 for spacing the distal ends of the first and second proximal elements 504*a*, 504*b* during collapsing.

Figure 9:
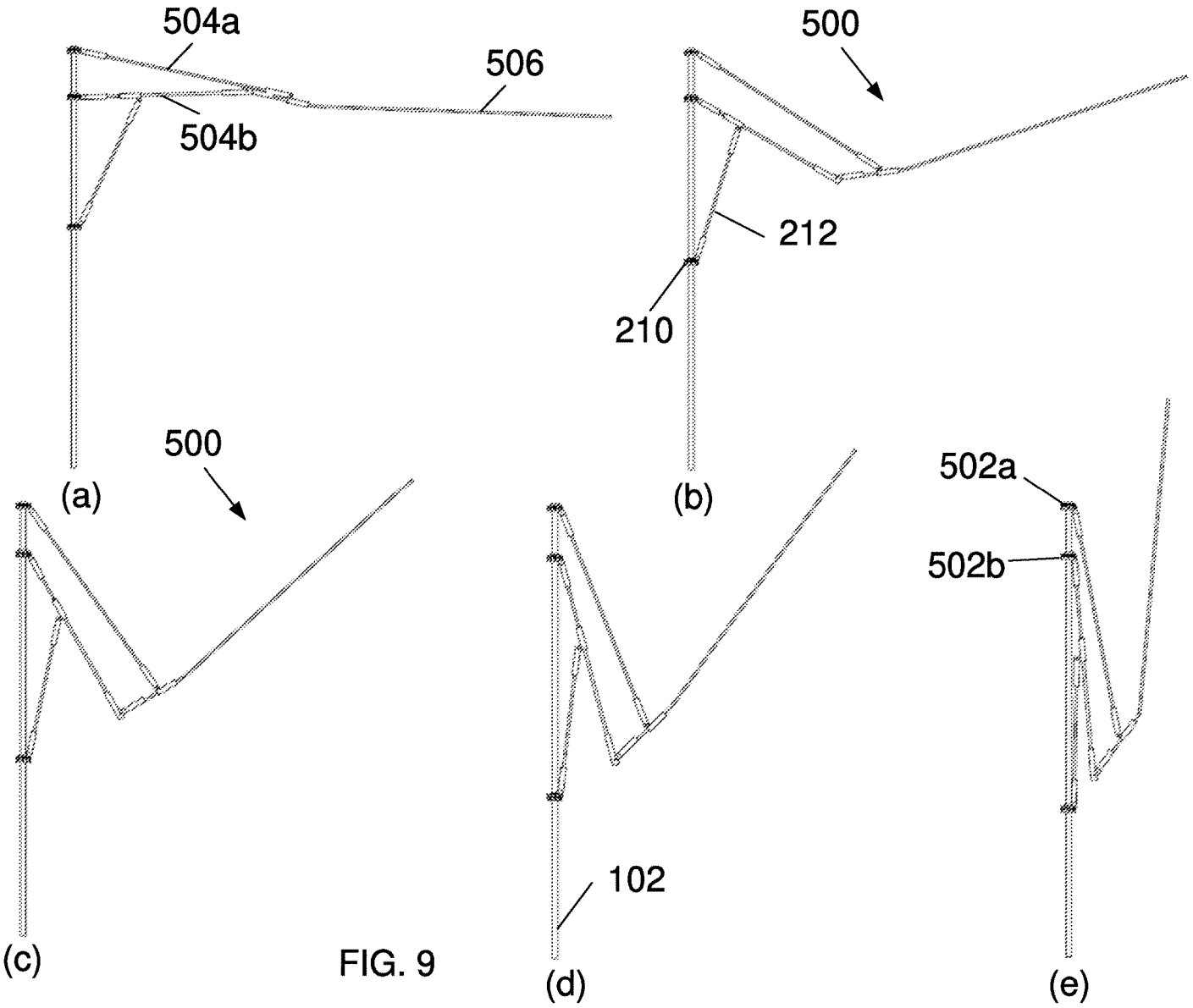
FIG. 9*a*-9*e* show sequential side views of a rib of the collapsing portable shelter of FIG. 1 in accordance with an embodiment of the present invention.

FIG. 9 shows an arrangement where an obtuse angle is formed between the first proximal element 504*a* and the distal element 506 when the shelter is expanded and in use. The distal element 506 is bent to change the roof pitch.

A person skilled in the art will appreciate that many embodiments and variations can be made without departing from the ambit of the present invention.

In one embodiment, the anchors 106 may include pegs for pegging to hard ground (e.g. grass).

In one embodiment, the ribs 500 can be used in a hand-held umbrella which can fold to half the length of a conventional umbrella. Compact handbag umbrellas fold down to a similar length, however they use a complicated triple fold, require numerous parts and due to complexity, tend to be cheaply made and are frequently thrown away which is an environmental problem. Such triple fold umbrellas also provide a lesser diameter of coverage than the preferred embodiment above.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. A portable shelter assembly including:

a support; and an expandable shelter for being supported by the support and expanding to shelter at least one person, the shelter including ribs extending from the support, each rib including:

one or more proximal elements pivotally mounted to the support, and a distal element extending from the proximal elements and configured to move outwardly to expand the shelter when the proximal elements pivot in a first direction;

wherein the ribs can be extended independently, one at a time; and wherein the distal and proximal elements fold together when collapsing the shelter so that outer surfaces of an expanded canopy supported by the ribs fold together; moisture from rain being contained within the collapsed shelter and the outer surface of the collapsed shelter, being the inner surface of the expanded canopy, is dry.

2. A portable shelter assembly as claimed in claim 1, wherein the distal elements can be simply pulled down one at a time to lift the associated proximal elements and extend the ribs, or pulled down together to lift the proximal elements and extend the ribs.

3. A portable shelter assembly as claimed in claim 1, wherein the elements are substantially parallel and/or stacked when the shelter is collapsed to advantageously form an extremely compact shelter for storage whilst forming an expansive shelter when expanded.

4. A portable shelter assembly as claimed in claim 3 wherein, when stacked, the distal element is located between the proximal elements.

5. A portable shelter assembly as claimed in claim 1, wherein (a) the distal element is further configured to move inwardly to collapse the shelter when the proximal elements pivot in a second direction opposite the first direction; or (b) the first direction is in an upward direction; or (c) ends of the proximal elements come together proximal the distal element during expansion of the shelter to form a secure triangular structure; or (d) at least one of the proximal elements includes a retainer for retaining the distal element; or (e) the expandable shelter includes a canopy which impedes further rotation of the proximal elements; or (f) the shelter is an umbrella or a beach shelter with weighted peripheral anchors.

6. A portable shelter assembly as claimed in claim 1, wherein the distal element is pivotally mounted to at least one of the proximal elements, and pivots in an opposite direction to the proximal elements.

7. A portable shelter assembly as claimed in claim 1, wherein the one or more proximal elements include a first proximal element and a second proximal element, wherein the distal element is pivotally mounted to the first proximal element at a connection point on the distal element that is located at a distance from a proximal end of the distal element, and wherein the distal element is pivotally mounted to the second proximal element at the proximal end of the distal element.

8. A portable shelter assembly as claimed in claim 1, including a spacer for spacing the distal ends of the proximal elements during collapsing.

9. A portable shelter assembly as claimed in claim 1, wherein an obtuse angle is formed between the uppermost proximal element and the distal element when the shelter is expanded and in use.

10. A portable shelter assembly as claimed in claim 1, wherein one or more proximal elements for each rib further comprises a first proximal element and a second proximal element; and wherein, for each rib, the distal element is separately connected to each of the first and second proximal elements.

11. A portable shelter assembly as claimed in claim 10, wherein the first proximal element is pivotally mounted to the support at a first mount fixed to the support; and wherein the second proximal element is pivotally mounted to the support at a second mount fixed to the support, the second mount being spaced from the first mount along the support.

12. A portable shelter assembly as claimed in claim 10, wherein the distal element is mounted to the first proximal element at a connection point on the distal element that is located at a distance from a proximal end of the distal element, and wherein the distal element is mounted to the second proximal element at the proximal end of the distal element.

13. A portable shelter assembly as claimed in claim 1, wherein the distal element of one rib may be pulled down to lift the associated one or more connected proximal elements of the one rib and extend the one rib independently of the proximal elements of the remaining ribs.

14. A portable shelter assembly including:

a support; and an expandable shelter for being supported by the support and expanding to shelter at least one person, the shelter including ribs extending from the support, each rib including:

one or more proximal elements pivotally mounted to the support, and a distal element extending from the proximal elements and configured to move outwardly to expand the shelter when the proximal elements pivot in a first direction: wherein the ribs can be extended independently, one at a time; and wherein at least one of the proximal elements includes a guide permitting sliding of the distal element there-through.

15. A portable shelter assembly as claimed in claim 14, wherein the distal element includes an impediment for impeding free sliding through the guide.

16. A portable shelter assembly as claimed in claim 15, wherein the impediment includes a rounded formation.

17. A portable shelter assembly as claimed in claim 15, wherein the distal element is pivotally mounted to the at least one of the proximal elements at a connection point on the distal element that is located at a distance from a proximal end of the distal element.

18. A portable shelter assembly including:

a support; and an expandable shelter for being supported by the support and expanding to shelter at least one person, the shelter including ribs extending from the support, each rib including:

one or more proximal elements pivotally mounted to the support, and a distal element extending from the proximal elements and configured to move outwardly to expand the shelter when the proximal elements pivot in a first direction; wherein the ribs can be extended independently, one at a time; and wherein the proximal elements include two elements, namely:

a first proximal element pivotally mounted to the support at a first mount fixed to the support; and a second proximal element pivotally mounted to the support at a second mount fixed to the support, the second mount being spaced from the first mount along the support;

wherein:

the distal element extends from the first proximal element and is configured to move outwardly to expand the shelter when the first proximal element pivots in a first direction; and a distal end of the second proximal element is configured to slide along the distal element.

19. A portable shelter assembly including:

a support; and an expandable shelter for being supported by the support and expanding to shelter at least one person, the shelter including ribs extending from the support, each rib including:

one or more proximal elements pivotally mounted to the support, and a distal element extending from the proximal elements and configured to move outwardly to expand the shelter when the proximal elements pivot in a first direction: wherein the ribs can be extended independently, one at a time; and wherein a stretcher is located between the proximal elements.

* * * * *